United States Patent [19]

White

[11] 4,342,527

[45] Aug. 3, 1982

[54] SUPPORT ASSEMBLY FOR UNDERGROUND MINE AND TUNNEL ROOFS

[75] Inventor: Claude C. White, Birmingham, Ala.

[73] Assignee: Birmingham Bolt Company, Birmingham, Ala.

[21] Appl. No.: 168,410

[22] Filed: Jul. 10, 1980

[51] Int. Cl.[3] ..... E21D 21/00

[52] U.S. Cl. ..... 405/259; 411/24; 411/60

[58] Field of Search ..... 405/259, 260; 411/24, 411/25, 44, 57, 60–63, 75; 52/282

[56] References Cited

U.S. PATENT DOCUMENTS

| | | | |
|---|---|---|---|
| 2,388,297 | 11/1945 | Slaughter | 52/282 |
| 3,808,938 | 5/1974 | Chromy | 411/57 |
| 3,815,467 | 6/1974 | Fisher | 411/60 |
| 4,147,444 | 4/1979 | Herb et al. | 411/60 X |

FOREIGN PATENT DOCUMENTS

| | | | |
|---|---|---|---|
| 609944 | 12/1960 | Canada | 405/259 |

*Primary Examiner*—David H. Corbin
*Assistant Examiner*—Nancy J. Pistel
*Attorney, Agent, or Firm*—Shlesinger, Arkwright, Garvey & Dinsmore

[57] ABSTRACT

This is a support assembly for underground mine and tunnel roofs. The assembly includes a tubular member comprising two opposed semi-cylindrical portions, the opposed longitudinal edges on one side of the member being connected together. Portions of the edges on the opposite side of the member are provided with one or more complemental mating angular recesses, which together form a tapered opening in the tubular wall for receiving wedge members. A ram successively engages the wedge members to force the same through the tapered opening, to effect expansion of the tubular member into bonding engagement with the roof.

6 Claims, 18 Drawing Figures

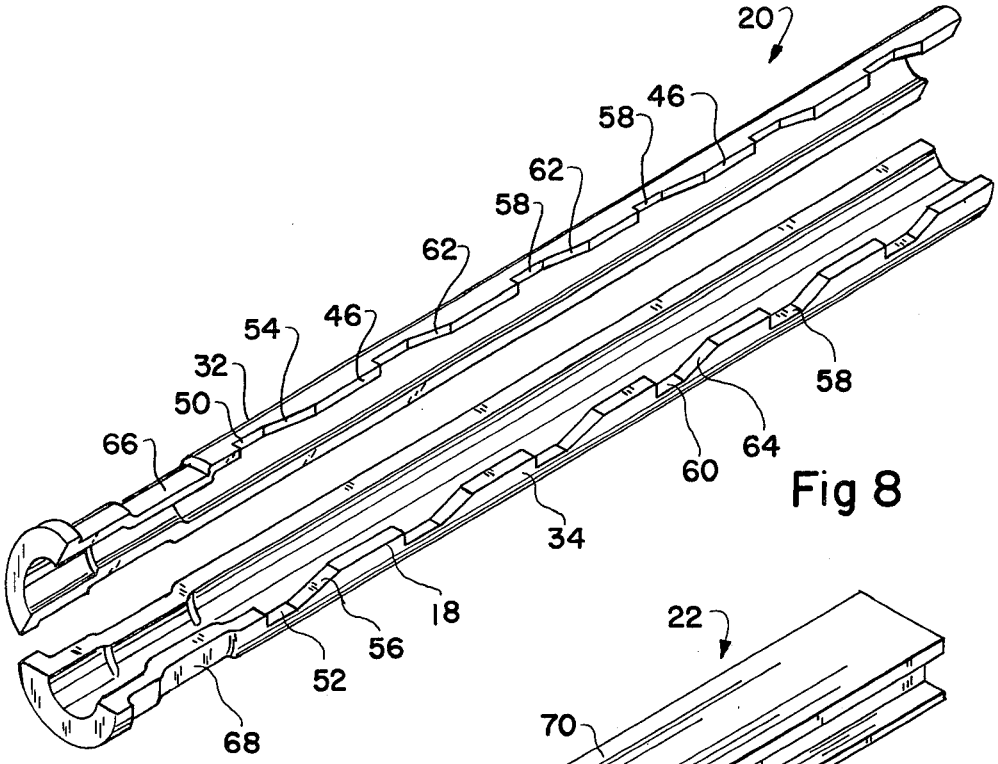
Fig 8
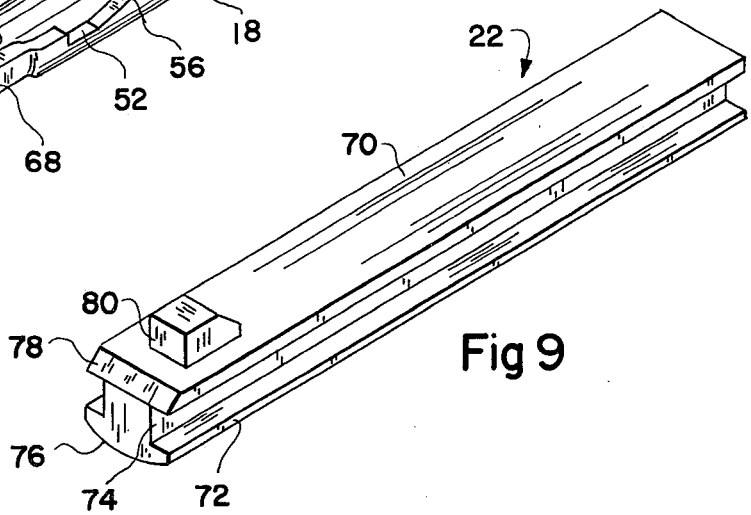
Fig 9
Fig 10
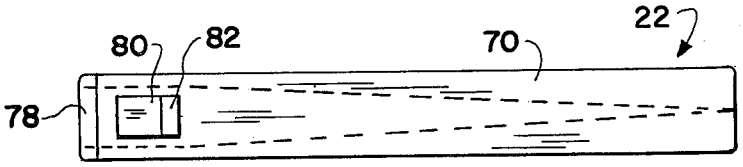
Fig 11
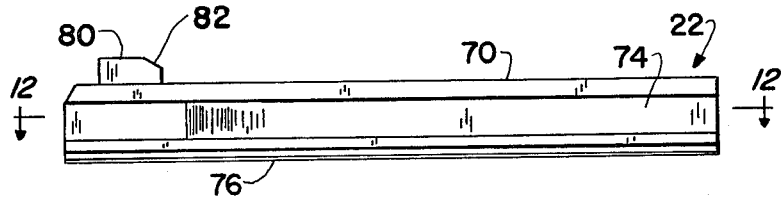
Fig 12
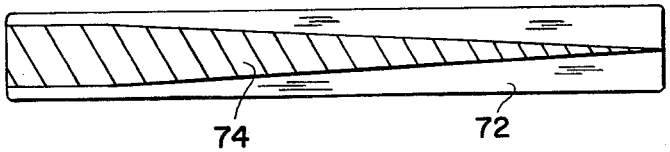
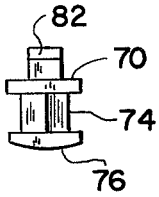
Fig 13

SUPPORT ASSEMBLY FOR UNDERGROUND MINE AND TUNNEL ROOFS

BACKGROUND OF THE INVENTION

In mining, or like operations, it has been found that mine roof bolts inserted in roof openings, and fully grouted in resin or cement, very often provide better roof control than tensioned bolts. For many years, wooden dowels have been used in situations where a wet condition of the roof exists, with the result that the water causes the wood to expand and grip the walls of the hole throughout its length, thus providing satisfactory roof strengthening.

Various means of producing the desired bonding effect between structural members and the roof have been tried such as a split set which is forced into the hole by hammer blows, and a worley bolt which embodies a solid steel rod which is driven into the roof. These devices do not, however, produce the bond strength necessary under certain mining conditions, or are unsatisfactory for other reasons.

More recently, a circumferentially compressible member such as disclosed in U.S. Pat. Nos. 3,922,867 and 4,012,913 have been employed for the present purpose, but it has been found that better bonding results are obtainable with members which are in tension after installation rather than compression.

An example of a member held in tension is disclosed in U.S. Pat. No. 4,147,444 which relates to an expansion dowel having a tubular member which is longitudinally split, and forced apart by a single spreader into engagement with the roof in which it is inserted. A very limited and non-uniform expansion of the number is effected with this arrangement.

SUMMARY OF THE INVENTION

The present invention is an improved roof support assembly comprising a split tubular member which is uniformly expanded throughout its length by wedge members, for bonding engagement with the roof of a mine or tunnel.

The assembly includes a tubular member comprising like semi-cylindrical portions in facing engagement, one opposed pair of edges being connected together, and the other pair of edges being provided with a series of opposed complemental cut out portions each pair of which form a tapered opening for the reception of an elongated wedge member positioned therein, the wedge member being movable longitudinally of the tubular member to effect outward movement of the tubular member into bonding engagement with the roof.

The elongated wedge member of the present assembly is of substantially H-shape cross section, and includes a pair of spaced legs connected intermediate their length by a transverse section which is longitudinally tapered to provide a wedge portion which is held in engagement with the angularly recessed edges of the semi-cylindrical portions of the tubular member and, upon movement of the wedge member longitudinally, the portions are spread slightly apart by an application of force thereto, for bonding the tube to the walls of the hole.

Each elongated wedge member further includes an extension or ear portion which extends inwardly of the tubular member from the wedge member, which extension is engaged by a ram inserted into the tubular member for driving the wedge member longitudinally of the tubular member, for forcing the proximate edge of the semi-cylindrical portions of the tubular member apart and into bonding engagement with the walls of the hole.

Upon application of a predetermined force to the extension, it will be severed from the wedge member. The ram is successively engaged with extensions or abutments of a plurality of wedge members positioned along the length of the tubular member to successively force the wedge members through complemental tapered openings, so that the entire length of the tubular member is under predetermined tension and is in bonding engagement with the roof of the mine or tunnel throughout its length.

DESCRIPTION OF FIGURES OF THE DRAWINGS

FIG. 8 is a perspective view of the tubular member forming a part of the present invention;

FIG. 9 is a perspective view of one of the wedge members forming a part of the present invention;

FIG. 10 is a side elevational view of the wedge member of FIG. 9;

FIG. 11 is a top plan view of the wedge member of FIG. 9;

FIG. 12 is a sectional view taken along the line 12—12 of FIG. 11, looking in the direction of the arrows;

FIG. 13 is an end elevational view of the wedge member of FIG. 9;

DETAILED DESCRIPTION OF THE INVENTION

Figure 1:
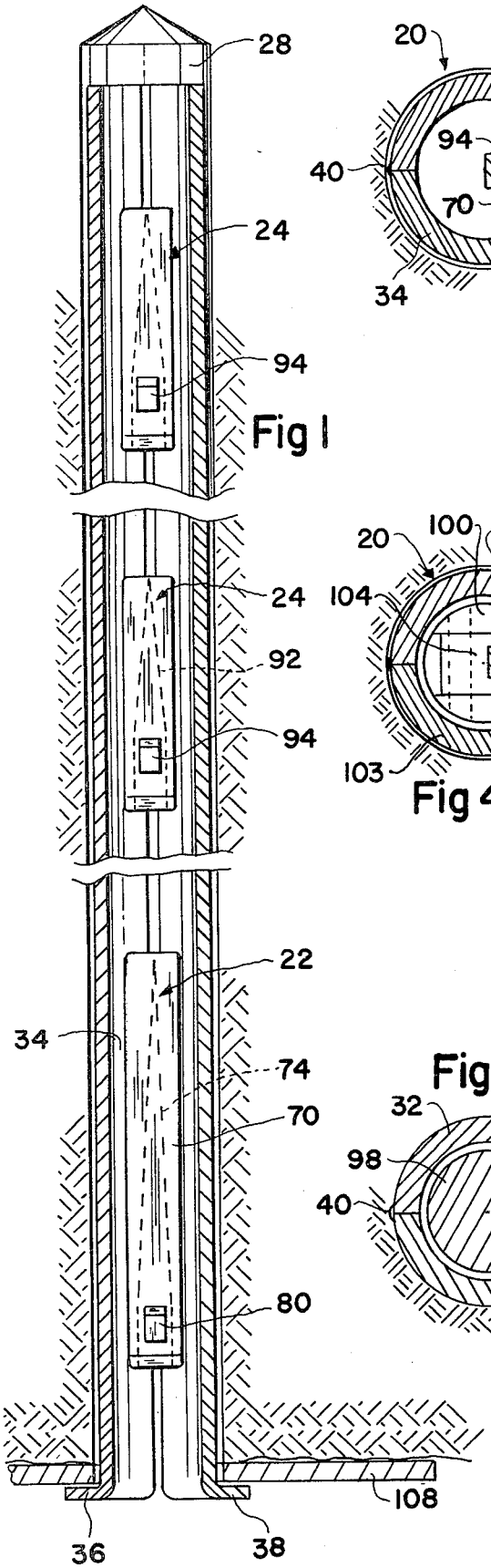
FIG. 1 is a longitudinal sectional view of the roof support assembly of the present invention, illustrating its application.

The roof support assembly of the present invention generally includes a tubular member 20, a first wedge member 22, a second wedge member 24, and a ram member 26, which support member is installed in a bore hole or opening 28 of a mine or tunnel roof 30.

Tubular member 20 includes a pair of like, substantially semi-cylindrical portions 32 and 34, which are provided with terminal outwardly extending flanges 36 and 38. One pair of opposed longitudinal edges of semi-cylindrical portions 32 and 34 are lightly secured together by spot welding 40, or the like, at intervals along the length of the tubular member for holding the portions together during shipment.

Figure 5:
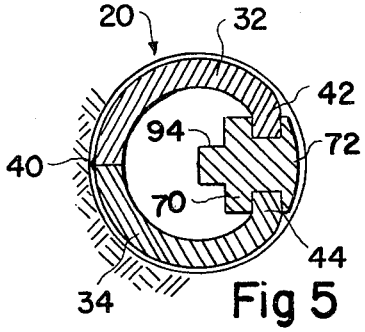
FIG. 5 is a sectional view taken along the line 5—5 of FIG. 2, looking in the direction of the arrows.
Figure 4:
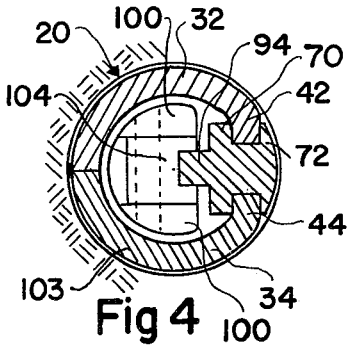
FIG. 4 is a sectional view taken along the line 4—4 of FIG. 2, looking in the direction of the arrows.
Figure 3:
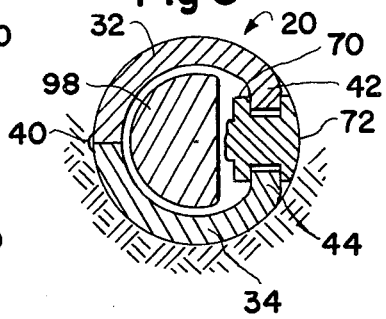
FIG. 3 is a sectional view taken along the line 3—3 of FIG. 2, looking in the direction of the arrows.

It will be noted from a consideration of FIGS. 3, 4 and 5 that opposed longitudinal edges of semi-cylindrical portions 32 and 34 are bent inwardly at 42 and 44 to provide a tubular member having a flattened section which is coextensive with the length of the tubular member. The longitudinal edges of the flattened sections are indicated at 46 and 48, and as shown in FIG. 8, are provided with a series of cut out or recessed portions including a first recessed portion having edges 50 and 52 which are in parallel relationship to edges 46 and 48, and angular edges 54 and 56, which are relatively long. The cut out or recessed portions of the two edges together form a tapered opening of inverted V-shape when semi-cylindrical portions 32 and 34 are mated together, for complemental engagement with first wedge member 22. In like manner, the balance of the length of the tubular member is provided with a series of like, recessed edges 58 and 60 and angular edges 62 and 64 for engagement with the second wedge member 24.

It will be further noted from a consideration of FIG. 8 that one end of the substantially semi-cylindrical portions 32 and 34 comprising tubular member 20 are peripherally crimped at 66 and 68, at a point adjacent the lower end of the member for reasons to be hereinafter more fully set out.

Wedge member 22 is shown to advantage in FIGS. 9 to 13 and includes an elongated body of generally H-shape cross section comprising an inner leg 70 and an outer leg 72 which lie in parallel, spaced relation, which legs are joined intermediate their width by a tapering wedge section 74 which is adapted for positioning in the tapered opening formed by recess edges 50 and 52 and angular edges 54 and 56. Outer leg 72 is transversely arcuate as indicated at 76, so that, when engaged with tubular member 20, the outer surface of the leg, in combination with the flattened sections of the semi-cylindrical portions of the tubular member, lie along the circumference of the roof or tunnel opening. It will also be noted that the opposed edges of semi-cylindrical portions 32 and 34 lie between inner and outer legs 70 and 72 so that there is no accidental displacement of the wedge member from engagement with the edges of the semi-cylindrical portion.

One end of inner leg 70 is beveled at 78 to avoid engagement by ram member 26 when the latter is forcing the wedge member through the tapered opening of the tubular member.

Wedge member 22 further includes an abutment or ear 80 near one end thereof which is engaged by ram member 26 for urging wedge member 22 longitudinally of tubular member 20. The abutment is of generally parallelepiped shape, with the inner end beveled at 82.

Wedge member 24 is similar in construction to wedge member 22, with the exception that it is considerably shorter in length. Member 24 includes an inner leg 84 having a beveled end portion 86, an outer leg 88 having an outer transversely arcuate surface 90, a wedge section 92 and an abutment or ear 94 extending inwardly of the tubular member from inner leg 84, the abutment having a beveled surface 96. Abutment or ear 94 is engaged by ram member 26 for driving the wedge members 24 successively through the tapered openings of tubular member 20.

It will be noted from a consideration of the drawings that first wedge member 22 is substantially longer than wedge member 24, and that wedge section 74 forms an angle between 5° and 10°, while wedge section 92 of wedge member 24 forms an angle of between 10° and 15°. Also, angular edges 54 and 56 of semi-cylindrical portions 32 and 34 are disposed at a smaller angle to the longitudinal edges thereof than angular edges 62 and 64 so that, when engaged by wedge member 22, greater force can be exerted on the tubular member to initially urge it outwardly into engagement with the mine or tunnel roof.

Ram member 26 includes an elongated rod 98, the lower end of which may be engaged by mechanical means for forcing the rod upwardly into successive engagement with the wedge members. The upper end of elongated rod 98 is enlarged and includes a pair of spaced ears 100 extending upwardly from said rod, between which a cutting head 102 is mounted on a shaft 103 extending between the spaced ears. The upper edge of cutting head 102 is provided with a flat portion 104 which engages the under side of the wedge members and a beveled portion 106 onto which the abutments of the wedge members drop after being severed by the ram member.

OPERATION

In use of the assembly of the present invention, tubular member 20 is inserted through an opening in a roof support plate 108 into opening 28 of a mine or tunnel roof with support plate 108 lying between flanges 36 and 38 and the lower limit of the roof.

Ram 26 is next inserted into tubular member 20, and enlarged upper end of the ram frictionally engages the wall of the restricted passageway formed by crimped portions 66 and 68, forcing the tubular member upwardly into the opening until the support plate engages the roof and flanges 36 and 38 are contiguous with the support plate. Continued upward pressure on the ram forces the enlarged upper end thereof past the restricted passageway.

Figure 2:
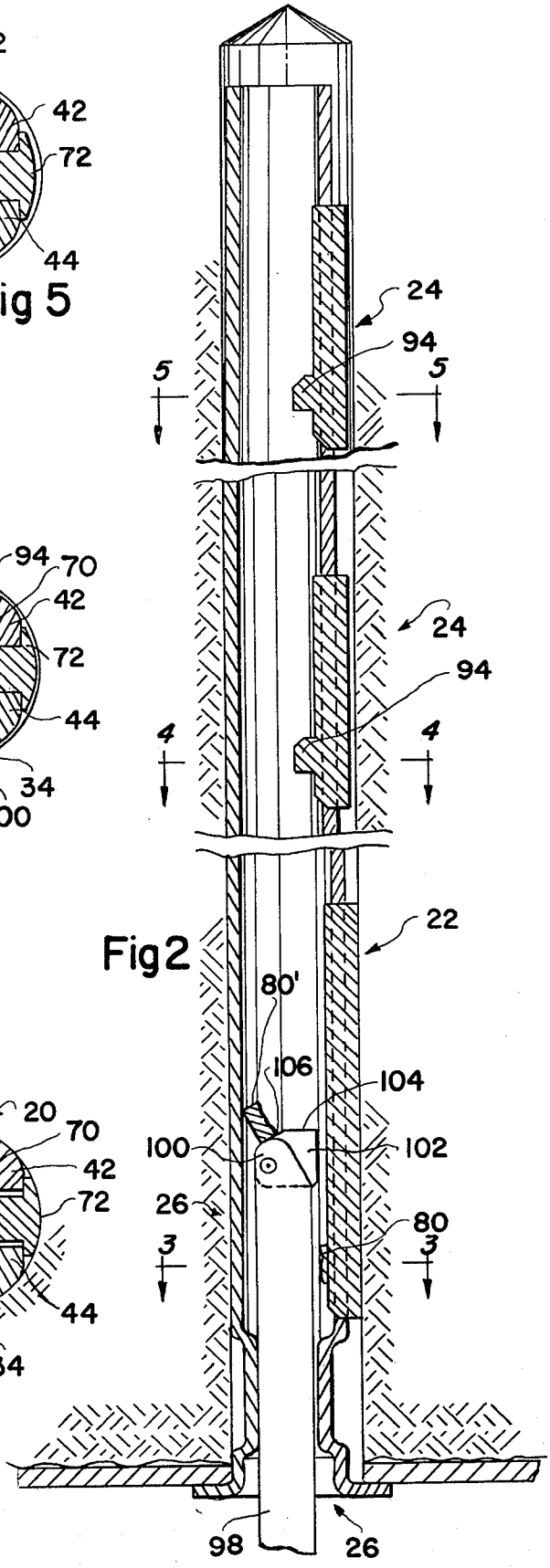
FIG. 2 is a view similar to FIG. 1, but taken at a 90° angle thereto.

After the ram passes the restriction, cutting surface 104 of cutting head 102 engages the underside of wedge member 22, forcing the wedge member upwardly through the tapered opening formed by angular edges 54 and 56 of semi-cylindrical portions 32 and 34, thereby effecting expansion or separation of the portions comprising the tubular member, by virtue of the engagement of wedge section 74 of the wedge member with angular edges 54 and 56. The semi-cylindrical portions are thereby expanded into bonding engagement with the roof surrounding the opening 28 and, when a predetermined force has been exerted which resists further upward movement of the wedge member, abutment 80 will be sheared off as indicated at 80′ and fall onto the beveled portion 106 of the cutting head as shown to advantage in FIG. 2.

Figure 6:
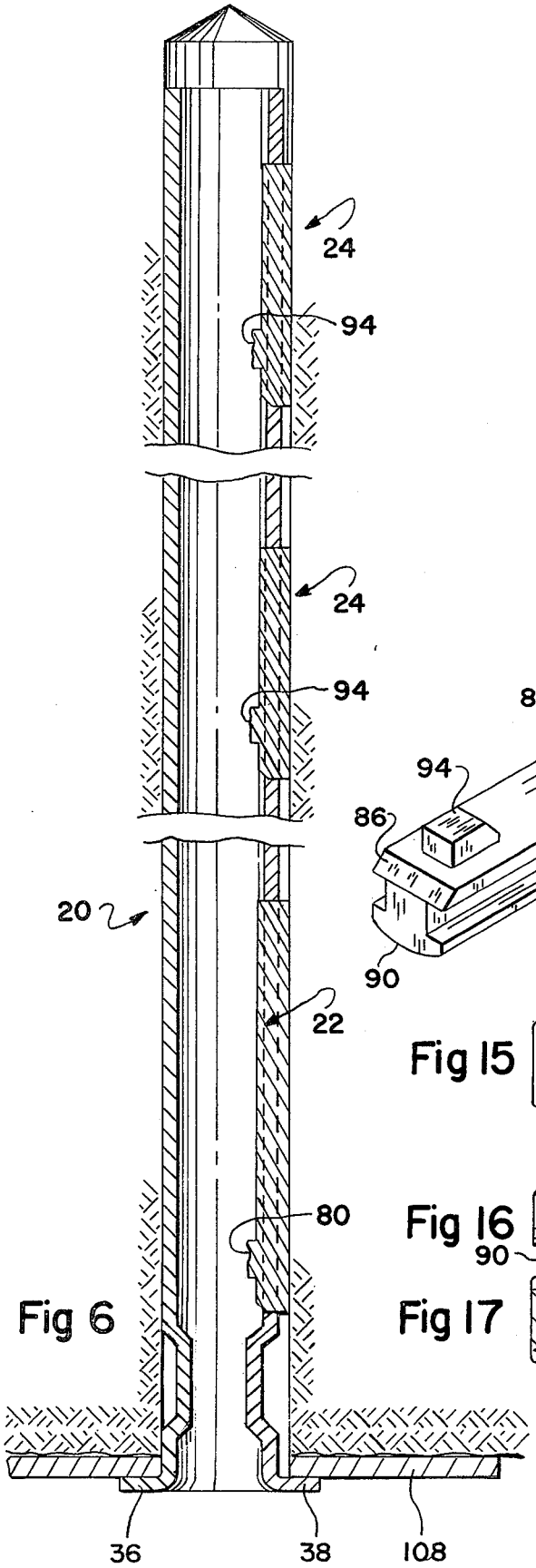
FIG. 6 is a view similar to FIG. 2 showing the support member assembly fully installed in a mine or tunnel roof opening.
Figure 7:
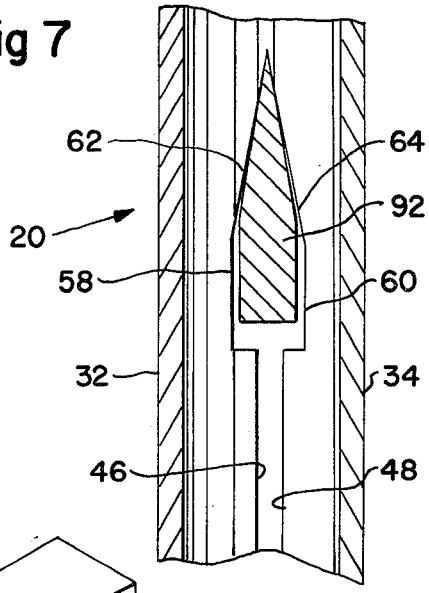
FIG. 7 is an enlarged fragmentary longitudinal section illustrating the manner of engagement of the wedge member with the tubular member, for effecting movement of the latter into tensioning engagement with the mine or tunnel roof.
Figure 14:
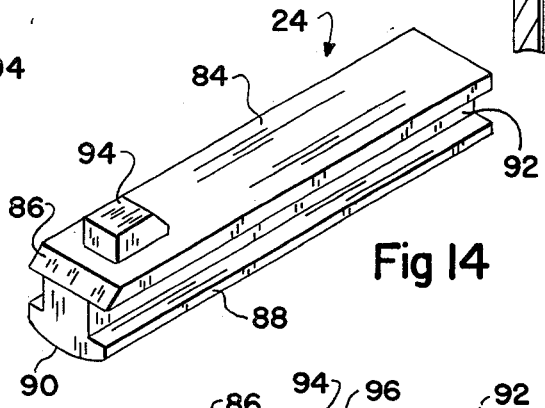
FIG. 14 is a perspective view of a second wedge member forming a part of the present invention.
Figure 15:
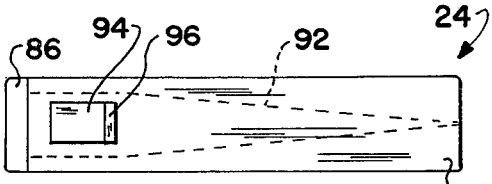
FIG. 15 is an elevational view of the wedge member of FIG. 14.
Figure 16:
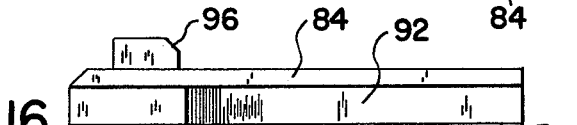
FIG. 16 is a top plan view of the wedge member of FIG. 14.
Figure 17:
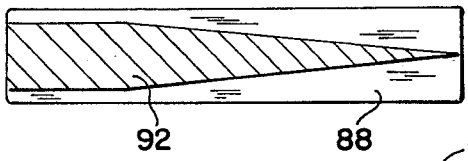
FIG. 17 is a sectional view taken along the line 17—17 of FIG. 16, looking in the direction of the arrows.
Figure 18:
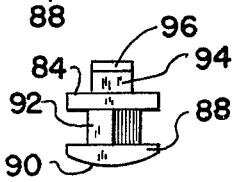
FIG. 18 is an end view of the wedge member of FIG. 14.

The upward movement of ram member 26 is continued and cutting head 102 is successively engaged with abutments 94 of each of the wedge members being forced through the tapered opening, until a predetermined force results in the shearing of abutment 94, and there has been uniform and complete expansion of the tubular member throughout its length, as shown in FIG. 6.

After the upmost wedge member has expanded the tubular member, ram member 26 may be withdrawn together with the severed abutment portions of the wedge members. By virtue of the mounting of cutting head 102 on shaft 104, the cutting head is permitted to pivot about the shaft in order to avoid contact with the wedge members as the ram member is withdrawn.

The installation of the present support assembly is simple, quick and a positive indication of tube pressure against the wall of the hole, which can be shown on gauges reading the upper thrust on the ram. The pressure on these gauges will vary nearly directly with the expansion force for any particular wedge angle, the only variable being the friction between the wedge and edges of the two semi-cylindrical tubular portions. Such friction can be controlled and easily determined by experiments for production materials.

The assembly of the present invention assumes the tubular member is held in tension against the wall of the roof opening, the force being exerted by the tubular member being uniform throughout its length, by virtue of the wedge members and severable abutments used in driving the wedge members into position, thereby providing an assembly which is reliable, and in which the tubular member is in bonding engagement with the roof for properly supporting the roof of the mine or tunnel.

While there has been herein shown and described the presently preferred form of this invention, it is to be understood that such has been done for purposes of illustration only, and various changes may be made therein within the scope of the appended claims.

What is claimed is:

1. A support assembly for positioning in openings in underground mine and tunnel roofs, said assembly including (a) an elongated tubular member comprising a pair of semi-cylindrical portions in facing relationship (b) means for joining one pair of opposed longitudinal edges of said semi-cylindrical portions together (c) the other pair of opposed longitudinal edges having a plurality of angularly disposed portions in facing engagement with each other, providing a plurality of tapered openings in the tubular member wall (d) a plurality of wedge members positioned in each of the tapered openings (e) each of said wedge members including a wedge section engaging the facing, angularly disposed portions of the longitudinal edges (f) an abutment connected to each of said wedge members and extending inwardly of said tubular member (g) said wedge member nearest the lower end of said tubular member being longer than the remaining wedge members, and the angle formed by the wedge section of said wedge member nearest the lower end of the tubular member being smaller than the angle formed by the wedge section of the remaining wedge members, whereby greater force can be exerted by the longer wedge member to initially urge said tubular member outwardly into engagement with the mine or tunnel roof, and (h) a ram inserted into said tubular member and successively engageable with each of said abutments for urging said wedge members upwardly into the tapered openings, thereby spreading said semi-cylindrical portions apart and effecting expansion of said tubular member into bonding engagement with the mine or tunnel roof, each of said abutments being sheared from said wedge members by said ram upon application of a predetermined force on each abutment.

2. A support assembly for positioning in openings in underground mine and tunnel roofs, said assembly including (a) an elongated tubular member comprising a pair of semi-cylindrical portions in facing relationship (b) means for joining one pair of opposed longitudinal edges of said semi-cylindrical portions together (c) the other pair of opposed longitudinal edges having at least one portion angularly disposed with respect to the longitudinal edges of the semi-cylindrical portions and in facing engagement with each other, thereby providing a tapered opening in the tubular member wall (d) a wedge member positioned in the tapered opening (e) said wedge member including a wedge section engaging the angularly disposed edges of the semi-cylindrical portions, and movable in a direction to spread the latter apart and expand the tubular member into bonding engagement with the mine or tunnel roof (f) an abutment connected to said wedge member and extending inwardly of said tubular member, and (g) a ram inserted into said tubular member and engageable with said abutment for urging said wedge member upwardly into the tapered opening, thereby spreading said semi-cylindrical portions apart and effecting expansion of said tubular member into bonding engagement with the mine or tunnel roof, said abutment being sheared from said wedge member by said ram upon application of a predetermined force on the abutment (h) the wall of a portion of said tubular member adjacent the lower end thereof being peripherally crimped to provide a restricted passageway (i) said peripherally crimped portion of said tubular member being frictionally engaged by said ram and forced upwardly in the roof opening.

3. A support assembly for positioning in openings in underground mines and tunnel roofs, the assembly including (a) an elongated tubular member comprising a pair of semi-cylindrical portions in facing relationship (b) means for joining one of the opposed longitudinal edges of said semi-cylindrical portions together (c) The other opposed edges of the semi-cylindrical portions having a plurality of angularly disposed edges, forming recessed areas, the recessed areas of the semi-cylindrical portions being in facing relationship to each other, thereby providing a plurality of tapered openings (d) a wedge member positioned in each tapered opening for movement longitudinally of the tubular member to effect expansion of the latter (e) said wedge member being of substantially H-shape cross section and comprising an inner leg and an outer leg in spaced, parallel relationship, and an intermediate tapering wedge section connecting the inner and outer legs (f) said tapering wedge section being in contiguous engagement with the opposed angular edges, and held in engagement therewith by engagement of said inner and outer legs with the inner and outer surfaces of said semi-cylindrical portions (g) each of said wedge members further including an abutment connected to said inner leg and extending inwardly of said tubular member (h) the first wedge member nearest the lower end of said tubular member being substantially longer than said other wedge members, and the angular edges engaged by said first member being disposed at a smaller angle to the longitudinal edge of said semi-cylindrical portions, whereby greater force is exerted on the tubular member by the wedge member to urge it outwardly into engagement with the mine or tunnel roof, and (i) a ram inserted into said tubular member and sequentially engageable with said abutments of the wedge members, for urging the wedge members upwardly in the tapered openings, whereby the semi-cylindrical portions are expanded into bonding engagement with the roof surrounding the opening, said ram engaging each abutment until a predetermined force has been exerted, at which time said ram successively shears off the abutment of each wedge member, to effect uniform and complete expansion of said tubular member throughout its length.

4. A support assembly for positioning in openings in underground mine and tunnel roofs, the assembly including (a) an elongated tubular member comprising a pair of semi-cylindrical portions in facing relationship (b) means for joining one of the opposed longitudinal edges of said semi-cylindrical portions together (c) the other opposed edges of the semi-cylindrical portions having a plurality of angularly disposed edges, forming recessed areas, the recessed areas of the semi-cylindrical portions being in facing relationship to each other, thereby providing a plurality of tapered openings (d) a wedge member positioned in each tapered opening for movement longitudinally of the tubular member to effect expansion of the latter (e) said wedge member being of substantially H-shape cross section and comprising an inner leg and an outer leg in spaced, parallel relationship, and an intermediate tapering wedge section connecting the inner and outer legs (f) said tapering wedge section being in contiguous engagement with the opposed angular edges, and held in engagement therewith by engagement of said inner and outer legs with the inner and outer surfaces of said semi-cylindrical portions (g) each of said wedge members further including an abutment connected to said inner leg and extending inwardly of said tubular member, and (h) a ram inserted into said tubular member and sequentially engageable with said abutments of the wedge members, for urging the wedge members upwardly in the tapered openings, whereby the semi-cylindrical portions are expanded into bonding engagement with the roof surrounding the opening, said ram engaging each abutment until a predetermined force has been exerted, at which time said ram successively shears off the abutment of each wedge member, to effect uniform and complete expansion of said tubular member throughout its length (i) said ram including an elongated rod (j) a pair of spaced ears extending upwardly from the end of said rod, and (k) a cutting head mounted between said spaced ears for engaging said wedge member abutments.

5. The support assembly of claim 4, wherein (a) said cutting head is pivotally mounted on a shaft extending between said spaced ears, whereby said cutting head is permitted to pivot about the shaft in order to avoid contact with the wedge members as the ram member is withdrawn.

6. A support assembly for positioning in openings in underground mine and tunnel roofs, the assembly including (a) an elongated tubular member comprising a pair of semi-cylindrical portions in facing relationship (b) means for joining one of the opposed longitudinal edges of said semi-cylindrical portions together (c) the other opposed edges of the semi-cylindrical portions having a plurality of angularly disposed edges, forming recessed areas, the recessed areas of the semi-cylindrical portions being in facing relationship to each other, thereby providing a plurality of tapered openings (d) a wedge member positioned in each tapered opening for movement longitudinally of the tubular member to effect expansion of the latter (e) said wedge member being of substantially H-shape cross section and comprising an inner leg and an outer leg in spaced, parallel relationship, and an intermediate tapering wedge section connecting the inner and outer legs (f) said tapering wedge sections being in contiguous engagement with the opposed angular edges, and held in engagement therewith by engagement of said inner and outer legs with the inner and outer surfaces of said semi-cylindrical portions (g) each of said wedge members further including an abutment connected to said inner leg and extending inwardly of said tubular member, and (h) a ram inserted into said tubular member and sequentially engageable with said abutments of the wedge members, for urging the wedge members upwardly in the tapered openings, whereby the semi-cylindrical portions are expanded into bonding engagement with the roof surrounding the opening, said ram engaging each abutment until a predetermined force has been exerted, at which time said ram successively shears off the abutment of said wedge member, to effect uniform and complete expansion of said tubular member throughout its length (i) a portion of the wall of said tubular member adjacent the lower end thereof being peripherally crimped to provide a restricted passageway through which said ram passes (j) the upper portion of said ram frictionally engaging the crimped portion of the tubular member and pushing the latter upwardly into the roof opening as far as possible, following which the ram is engaged with a wedge member abutment.

* * * * *